US007287781B1

(12) United States Patent
Hathaway

(10) Patent No.: US 7,287,781 B1
(45) Date of Patent: Oct. 30, 2007

(54) INTERACTIVE SPORTS CALENDAR

(76) Inventor: Brian Hathaway, 1640 B Treetop Trail, Akron, OH (US) 44313

( * ) Notice: Subject to any disclaimer, the term of this patent is extended or adjusted under 35 U.S.C. 154(b) by 381 days.

(21) Appl. No.: 10/274,604

(22) Filed: Oct. 21, 2002

(51) Int. Cl.
*B42D 5/04* (2006.01)

(52) U.S. Cl. ..... 283/2; 40/107

(58) Field of Classification Search ..... 281/21.1; 283/2–4, 56; 434/247; 40/107, 120, 156
See application file for complete search history.

(56) References Cited

U.S. PATENT DOCUMENTS

| | | | | | |
|---|---|---|---|---|---|
| 546,959 | A | | 9/1895 | Larzelere | |
| 758,808 | A | | 5/1904 | Bach | |
| 1,167,715 | A | | 1/1916 | Preo | |
| 1,431,577 | A | | 10/1922 | Feihl | |
| 3,290,812 | A | * | 12/1966 | Hunkins | 40/107 |
| 3,698,741 | A | | 10/1972 | Beebe, Jr. | |
| 3,783,543 | A | * | 1/1974 | Hemgren | 40/766 |
| 3,789,527 | A | * | 2/1974 | Mohr | 40/783 |
| 3,911,606 | A | * | 10/1975 | Hunkins | 40/110 |
| 3,964,195 | A | * | 6/1976 | Jordan | 40/107 |
| 4,145,828 | A | * | 3/1979 | Hillstrom | 40/793 |
| 4,164,910 | A | | 8/1979 | Feiler | |
| 4,282,667 | A | * | 8/1981 | Glade | 40/649 |
| 4,519,152 | A | * | 5/1985 | Seely et al. | 40/791 |
| 4,645,206 | A | | 2/1987 | Todd | |
| 4,887,373 | A | * | 12/1989 | Macaulay | 40/119 |
| 4,959,916 | A | * | 10/1990 | Cochrane | 40/603 |
| 4,975,061 | A | * | 12/1990 | Avrill | 434/304 |
| 5,090,735 | A | * | 2/1992 | Meaney et al. | 283/67 |
| 5,251,570 | A | | 10/1993 | Creech | |
| 5,257,940 | A | * | 11/1993 | Schaarschmidt | 434/304 |
| 5,316,342 | A | * | 5/1994 | Almo | 283/2 |
| 5,339,546 | A | * | 8/1994 | Rahwan | 40/107 |
| 5,387,011 | A | * | 2/1995 | Freund | 283/61 |
| 5,660,389 | A | * | 8/1997 | Freda, III | 273/249 |
| 5,690,364 | A | * | 11/1997 | Oleske et al. | 283/2 |
| 5,694,881 | A | | 12/1997 | Creech | |
| 5,855,006 | A | | 12/1998 | Huemoeller et al. | |
| 5,984,361 | A | * | 11/1999 | Westerman et al. | 281/22 |
| 6,106,017 | A | * | 8/2000 | Johnson | 283/2 |
| 6,210,296 | B1 | | 4/2001 | Gabriel | |
| 7,029,034 | B2 | * | 4/2006 | Newell | 283/2 |
| 2003/0224336 | A1 | * | 12/2003 | Jackson | 434/238 |

FOREIGN PATENT DOCUMENTS

| | | | |
|---|---|---|---|
| GB | 2124413 | * | 2/1984 |

* cited by examiner

*Primary Examiner*—Daniel W. Howell
(74) *Attorney, Agent, or Firm*—Michael I. Kroll

(57) ABSTRACT

The present invention 10 discloses an interactive sports season team-tracking poster for a sports fan's favorite team. The invention is a calendar-like chart for a sports season displaying a predetermined time period by day 20 having a postable element 30 that is completed by the user containing user selected sporting event statistics. As an example, a baseball season chart would be printed for the months of April through October with the favored team schedule imprinted thereon. The fan would be able to record game statistics on an attachable preprinted statistics form 30 for each sporting event related to their chosen team and attach the event statistics form onto the season chart for that event by removing a peel-off backing 32 on its back to expose a glue surface 34 for attachment to the poster of the present invention 10.

10 Claims, 9 Drawing Sheets

30

| | 1 | 2 | 3 | 4 | 5 | 6 | 7 | 8 | 9 | XI | R | H | E |
|---|---|---|---|---|---|---|---|---|---|---|---|---|---|
| A | | | | | | | | | | | | | |
| H | | | | | | | | | | | | | |

| | NAME | RECORD | ERA |
|---|---|---|---|
| SPA | | | |
| SPH | | | |
| WP | | | |
| LP | | | |
| S | | | |
| HR | | | |

NOTES:

FIG. 5

30

| POINTS PER GAME | 1st QUARTER | 2nd QUARTER | 3rd QUARTER | 4th QUARTER | OVERTIME | TOTALS |
|---|---|---|---|---|---|---|
| A | | | | | | |
| H | | | | | | |
| PASSING YRDS | | | | | | |
| SACKS | | | | | | |
| INTERCEPTIONS | | | | | | |
| FUMBLES | | | | | | |
| PASSES | | | | | | |
| FIELD GOALS | | | | | | |
| TIME OUTS | | | | | | |
| TOUCH DOWNS | | | | | | |
| PENALTIES | | | | | | |
| FIRST DOWNS | | | | | | |
| QUARTER BACK | | | | | | |

NOTES:

FIG. 9

INTERACTIVE SPORTS CALENDAR

BACKGROUND OF THE INVENTION

1. Field of the Invention

The present invention relates generally to a display board assembly and, more specifically, to sports game history, scoring, scheduling and announcing systems.

The present invention is an interactive sports season team-tracking poster for a sports fan's favorite team. The invention is a calendar-like chart for a sports season displaying a predetermined time period by day having a postable element that is completed by the user containing user selected sporting event statistics.

As an example, a baseball season chart would be printed for the months of April through October with the favored team schedule imprinted thereon. The fan is able to record game statistics on an attachable preprinted statistics form for each sporting event related to their chosen team and attach the event statistics form onto the season chart for that event.

2. Description of the Prior Art

There are other scoring, scheduling and announcing devices designed for sports games. Typical of these is U.S. Pat. No. 546,959 issued to J. S. Larzelere on Sep. 24, 1895.

Another patent was issued to E. Bach on May 3, 1904 as U.S. Pat. No. 758,808. Yet another U.S. Pat. No. 1,167,715 was issued to J. L. Preo on Jan. 11, 1916 and still yet another was issued on Oct. 10, 1922 to F. W. Feihl as U.S. Pat. No. 1,431,577.

Another patent was issued to H. Beebe, Jr. on Oct. 17, 1972 as U.S. Pat. No. 3,698,741. Yet another U.S. Pat. No. 4,164,910 was issued to R. Feiler on Aug. 21, 1979. Another was issued to A. B. Todd on Feb. 24, 1987 as U.S. Pat. No. 4,645,206 and still yet another was issued on Feb. 25, 1992 to Meaney, et al. as U.S. Pat. No. 5,090,735.

Another patent was issued to E. Creech on Oct. 12, 1993 as U.S. Pat. No. 5,251,570. Yet another U.S. Pat. No. 5,694,881 was issued to E. Creech on Dec. 9, 1997. Another was issued to Huemoeller et al. on Dec. 29, 1998 as U.S. Pat. No. 5,855,006 and still yet another was issued on Apr. 3, 2001 to W. J. Gabriel as U.S. Pat. No. 6,210,296.

U.S. Pat. No. 546,959

Inventor: J. S. Larzelere

Issued: Sep. 24, 1895

The invention consists of a game indicator or bulletin wherein the progress or condition and other matter of a game, such as football or baseball, may be readily announced to observers on opposite sides of the indicator.

U.S. Pat. No. 758,808

Inventor: E. Bach

Issued: May 3, 1904

The invention, among others, consists of a sheet for tallying points in whist comprising a series of similar rows of detachable numbers arranged in seven perforated squares or portions and one row for each whist hand, and secondary numbers or exponents in each squares or portion indicative of the hand to which the squares or portion belongs or relates.

U.S. Pat. No. 1,167,715

Inventor: J. L. Preo

Issued: Jan. 11, 1916

The invention relates to a class of devices adapted to be employed for displaying the results of athletic games, and the like. The device comprises a supporting board having a number of spaced vertical columns, a plurality of vertically disposed flexible retaining members provided on the board, one of the members being arranged between each of two adjacent columns, and said members being in spaced relation to the board to provide vertically disposed pockets in the board, and a plurality of flexible strips, each being removably disposed in one of the pockets so that one of the faces of each strip will be displayed in one of the supporting board, substantially as described and for the purpose specified.

U.S. Pat. No. 1,431,577

Inventor: F. W. Feihl

Issued: Oct. 10, 1922

This invention relates to printed schedules for a series of contests or engagements between teams of a group, its object being to provide a simple printed schedule so arranged as to convey to the observer at a glance a variety of information.

U.S. Pat. No. 3,698,741

Inventor: H. Beebe, Jr.

Issued: Oct. 17, 1972

A guide for a sport such as football in which one team is on offense while the other is on defense has relatively stiff covers and leaves hinged in the covers and having creases on vertical lines. On the outer half of the front side of each sheet are printed the names of the offensive members of a particular team above the defensive members and on the back side the defensive members above the offensive members. By folding the pages inward, the members of the two teams will be shown with the defensive members of each team opposite the offensive members of the other team.

U.S. Pat. No. 4,164,910

Inventor: R. Feiler

Issued: Aug. 21, 1979

A device for registering the score or points in a game or contest comprising a scoreboard member bearing indicia of all possible score points, score indicator markers and means for detachably fastening the score indicator markers to the scoreboard member in association with the individual indicia of the score points and athletic apparel comprising such score registering device.

U.S. Pat. No. 4,645,206

Inventor: A. B. Todd

Issued: Feb. 24, 1987

A unit point scoring system and scoreboard for use with a series of athletic games or other contests in even or odd numbers, or a single athletic game or other contest that is divided into even or odd numbered units of play. The individual competitions in a series or the individual units in a single contest are scored in the traditional manner, but the unit point scoring system takes the scoring history into account in order to maintain the competitive urge in contestants and interest in spectators by providing for the award of points for units of play won under a formula that positions both contestants in such a way that neither can be determined the winner before the conclusion of the series or single contest.

U.S. Pat. No. 5,090,735

Inventor: Meaney, et al.

Issued: Feb. 25, 1992

A game which combines skill and chance is disclosed for one or more players. According to the game, each player chooses, beforehand, the outcomes of actual athletic contests. The athletic contests are played in the course of a playing season by existing teams belonging to existing leagues. There are weekly contests, playoff contests, and a championship contest. Each player records his own choices and successes in a bound booklet preprinted with the opposing teams for each of the weekly contests, for the playoff games, and for the championship contest. A group record is kept on a board containing the names of each of the players, and provision for manually inserting the total number of successful choices of each player for each successive week, the cumulative successful choices of each player for all of the preceding weeks of the contest season continuing through the playoffs and concluding with the championship contest. Markers with pressure sensitive adhesive are provided for keeping track of individual contest winners, also, winners for the week and for the season.

U.S. Pat. No. 5,251,570

Inventor: E. Creech

Issued: Oct. 12, 1993

A scoreboard system for use in tournament play such as in golf, tennis and trap and skeet shooting events, which includes a plurality of scoreboard panels which are portable so as to be selectively moved between an outdoor support system and an indoor support system and wherein at least two of the scoreboard panels include two different player grid portions permanently displayed on the front and rear surfaces thereof for accommodating different types of tournaments having differing numbers of players and wherein the panels are reversible with respect to their support systems whereby, when the front surfaces are mounted in display relationship with respect to one another, a first grid pattern is established, and wherein, when the rear surfaces thereof are oriented in a display relationship, either a second or third grid pattern is created.

U.S. Pat. No. 5.694,881

Inventor: E. Creech

Issued: Dec. 9, 1997

A portable visual display assembly comprises modular sections selectively configurable between a combined full-size display board configuration and a separated plural smaller single display board configuration. The display boards can have identical or different grids permanently displayed on their front and back faces. The assembly includes wheels which are removable in both configurations. The display boards can be propped open to a selected angle. The visual display assembly is particularly suitable for use as a scoreboard for sporting event tournament play, such as for golf events, with the full-size configuration being advantageous for tournaments having a large number of participants.

U.S. Pat. No. 5,855,006

Inventor: Huemoeller, et al.

Issued: Dec. 29, 1998

The personal activity scheduling system accesses data from various sources to provide the user with information that is required to enable the user to conveniently and expeditiously schedule activities without requiring access to other sources of information. The personal activity scheduling system can include schedules of various sports activities, cultural events, birthdays and anniversaries, professional meetings and deadlines, and any other temporally based items of interest to the particular individual. Each of these temporally based activities can be associated with data representative of information required by the user to schedule an activity from the list of potential activities into the individual's personal calendar as well as make reservations and ticket purchases using this system.

U.S. Pat. No. 6,210,296

Inventor: W. J. Gabriel

Issued: Apr. 3, 2001

A portable tennis scorekeeper device includes a portable body attachable to an article of apparel or insertable within a pocket of an article of apparel worn by a tennis player and a scoreboard applied to a side of the portable body. The scoreboard includes a middle region and a pair of opposite side regions. The middle region includes a first portion having a plurality of numbers and letters associated with points scored in a game of a tennis match, a pair of tracks extending along opposite sides of the first portion, second and third portions each disposed on a side of one of the tracks opposite from the first portion and having a plurality of numbers associated with points scored in a tiebreaker of the tennis match, and a pair of markers each mounted to and for undergoing movement along one of the tracks and alignable with the numbers and letters of the first, second and third portions. The side regions of the scoreboard are each disposed on a side of one of the second and third portions opposite from the tracks. Each side region has a grid formed by a side axis, an end axis extending generally orthogonal to the side axis, a plurality of boxes arranged in rows and columns and aligned with one another adjacent to the side and end axes, a plurality of numbers associated with games won in one or more sets of the tennis match disposed numerically along the side axis and a plurality of numbers associated with sets of the tennis match disposed numerically along the end axis, and a plurality of markers each mounted to and being movable along the grid in generally orthogonal directions and positionable on one of the boxes of the grid and alignable with the numbers along each of the side and end axes of the grid.

While these sporting event boards may be suitable for the purposes for which they were designed, they would not be as suitable for the purposes of the present invention, as hereinafter described.

SUMMARY OF THE PRESENT INVENTION

The present invention discloses an interactive sports season team-tracking poster for a sports fan's favorite team. The invention is a calendar-like chart for a sports season displaying a predetermined time period by day having a postable element that is completed by the user containing user selected sporting event statistics. As an example, a baseball season chart would be printed for the months of April through October with the favored team schedule imprinted thereon. The fan would be able to record game statistics on an attachable preprinted statistics form for each sporting event related to their chosen team and attach the event statistics form onto the season chart for that event by removing a peel-off backing on its back to expose a glue surface for attachment to the poster of the present invention.

A primary object of the present invention is to provide means for recording selective sporting event statistics and posting said statistics onto a sports season calendar.

Another object of the present invention is to provide means to exhibit various sporting events' future schedules.

Yet another object of the present invention is to provide expedient means such as preprinted statistical forms and calendar-like board for displaying various results and facts of sporting events.

Still yet another object of the present invention is to provide efficient and attractive means of displaying a team's sporting events statistics.

Another object of the present invention is to enhance a fan's participation in a sporting event.

Yet another object of the present invention is to provide a fan with means for recording sporting event statistics for a favored team for the sporting event season.

Still yet another object of the present invention is to provide a sporting event season schedule for each team having their daily schedule imprinted thereon.

Additional objects of the present invention will appear as the description proceeds.

The present invention overcomes the shortcomings of the prior art by providing an interactive sports season team-tracking poster for a sports fan favorite team comprised of a sports season calendar-like chart having a plurality of preprinted forms whereon the fan is able to record game statistics and attach the statistics form onto the season chart for that event.

The foregoing and other objects and advantages will appear from the description to follow. In the description, reference is made to the accompanying drawings, which form a part hereof, and in which is shown, by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 5 is an enlarged view of the statistical game card.

FIG. 9 is an enlarged view of a football statistical game card.

LIST OF REFERENCE NUMERALS

Figure 1:
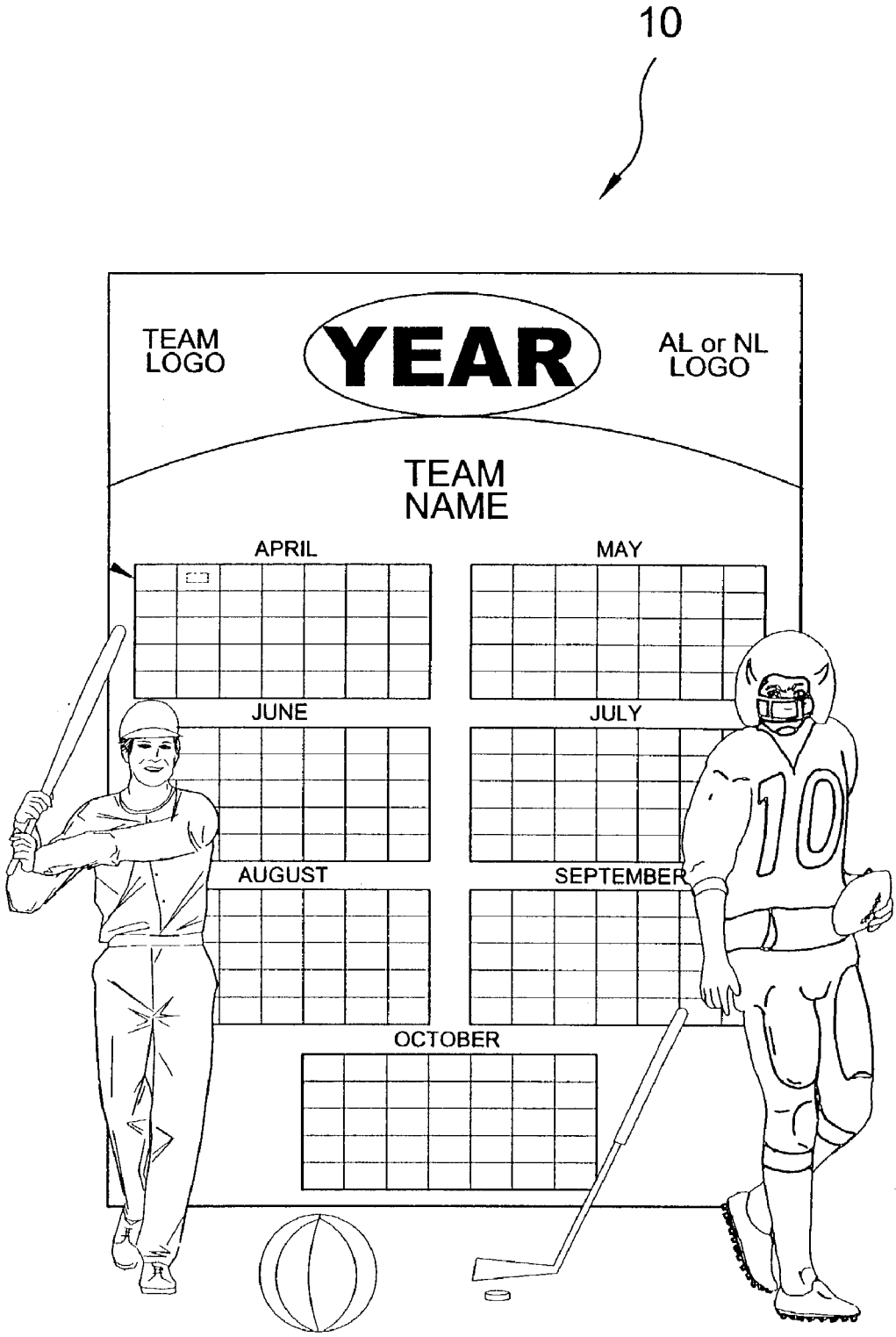
FIG. 1 is a pictorial view of the present invention.

With regard to reference numerals used, the following numbering is used throughout the drawings.

10 present invention
12 team name
14 team logo
16 league logo
18 year
20 day
22 month
24 blank dates
26 opposing team initials
28 home/away abbreviation
30 card
32 backing
34 glue surface
36 double-sided tape
38 frame

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a pictorial view of the present invention 10. The present invention 10 is an interactive sports season team-tracking poster for a sports fan favorite team. The invention is a calendar-like chart for a sports season. As an example which is shown, the baseball season chart would be printed for the months of April through October with the favored team schedule imprinted thereon. The fan is able to record game statistics on an attachable detachable preprinted statistics form and attach the statistics form onto the season chart for that game.

Figure 2:
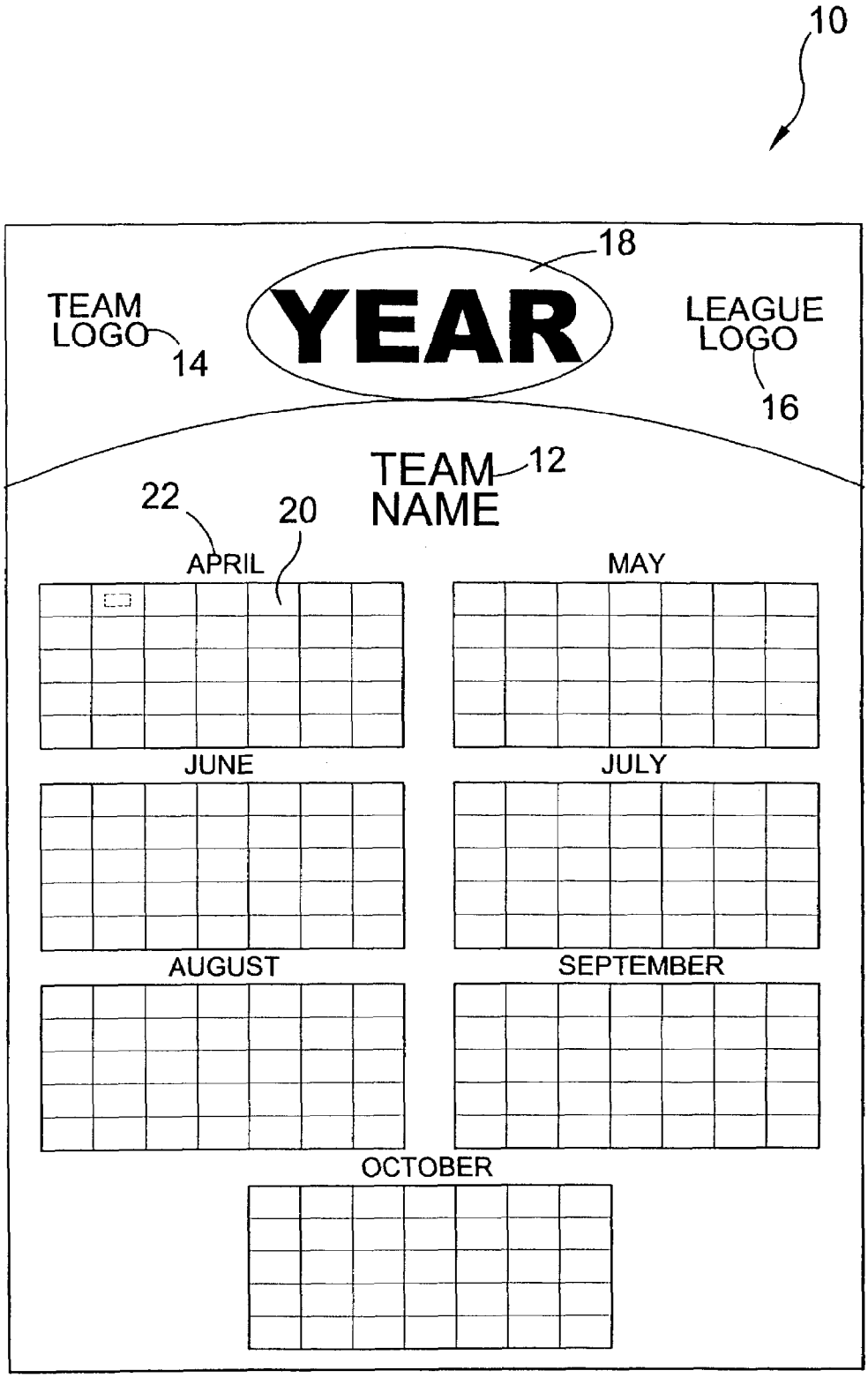
FIG. 2 is a frontal view of the present invention.

Turning to FIG. 2, shown therein is a frontal view of the present invention 10. Shown is the interactive sports season team tracking calendar-like poster. Having the team name 12, logo 14, league logo 16 and year 18 prominently displayed thereon. Each day 20 is displayed grouped by month 22 in calendar-like form with each day of the season schedule imprinted thereon. For illustrative purposes a baseball season schedule (April through October) is shown but the same game recording of statistical data can be applied to all team sporting events. The purpose is to enhance the fan experience by providing the ability for the fan to record real time game information.

Figure 3:
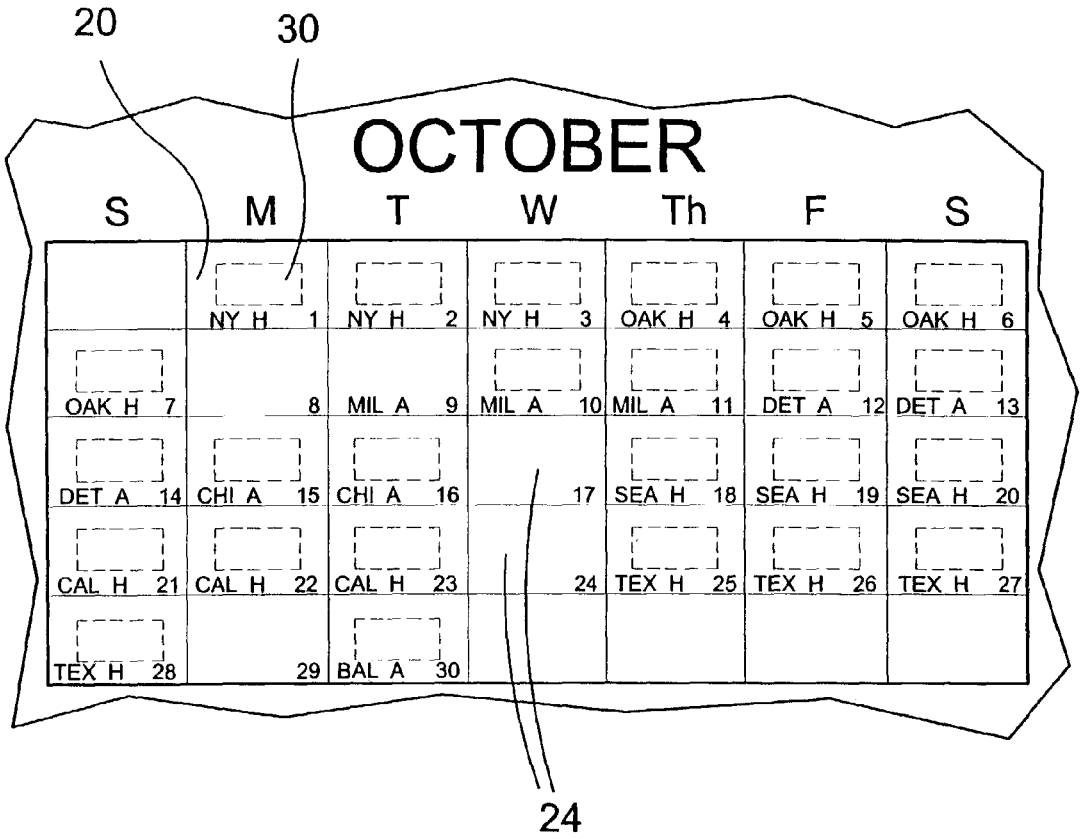
FIG. 3 is an enlarged partial view of the interactive sports season team tracking poster.

Turning to FIG. 3, shown therein is an enlarged partial view of the interactive sports season team tracking poster for a particular month. Shown is a partial view of the calendar-like chart of the present invention. The season chart is displayed in monthly calendar format with a designated space for each day 20 having each scheduled game indicted on the appropriate day by a mnemonic opposing team designation, which may also display the time of the scheduled event. Blank dates 24 are left open for possible rain dates or double-headers.

Figure 4:
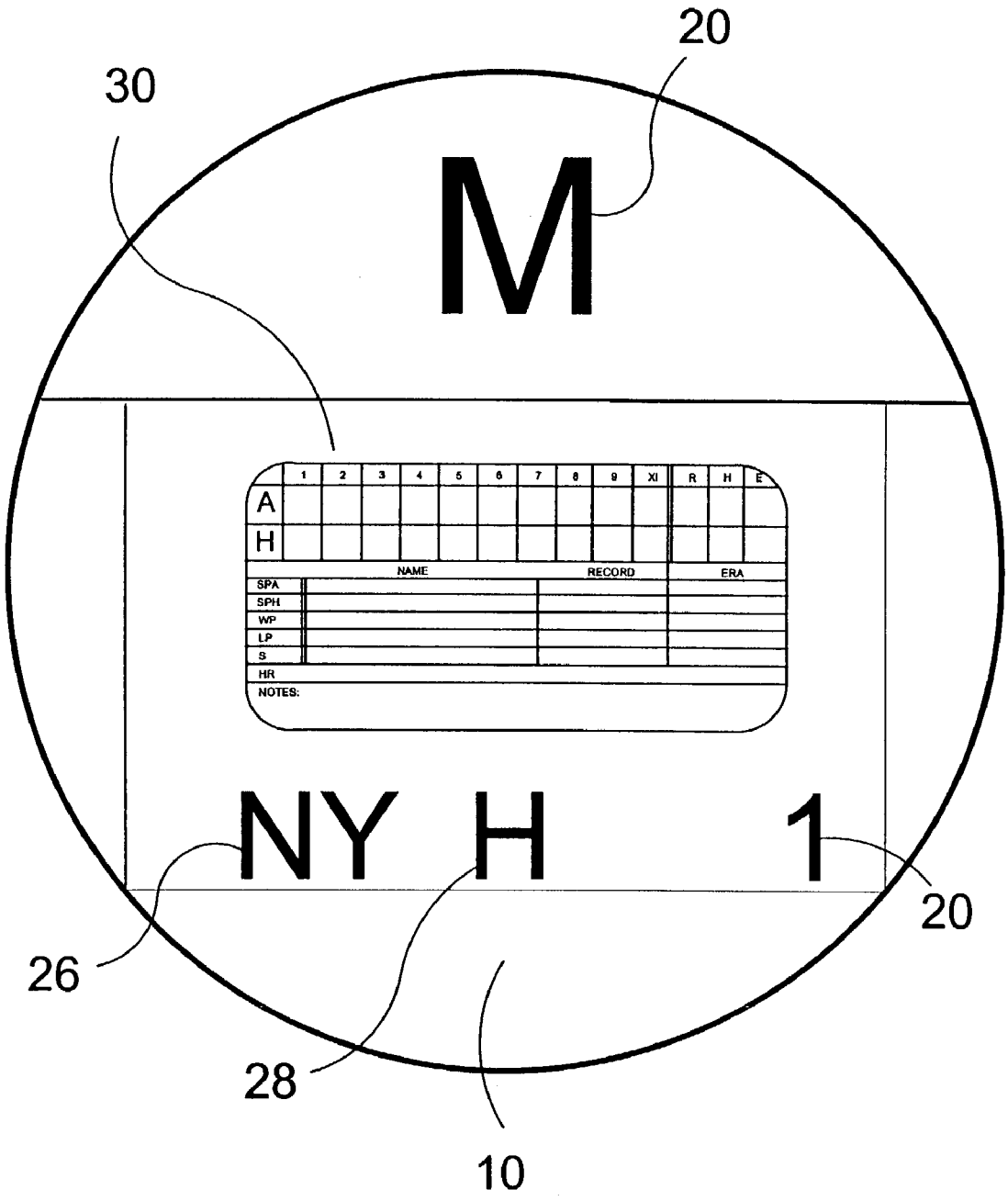
FIG. 4 is an enlarged view of a day designation.

Turning to FIG. 4, shown therein is an enlarged view of a day designation of the present invention 10. Shown is a day space having the day 20 of the month, opposing team initials 26, and whether the game is home or away 28. Positionable within the day space is the blank preprinted game statistical card 30 or sticker forming the interactive component of the present invention whereupon the fan can record game play statistics and attach the card within the designated day space.

Turning to FIG. 5, shown therein is an enlarged view of the statistical game card 30. Shown is an enlarged view of the statistical information game card 30 of the present invention. The game card 30 is attachable to the calendar-like sport season chart of the present invention. The game card 30 is a preprinted form with multiple labeled areas for recording game play statistics that can be selectively filled out by the fan. The game card 30 is attached to the calendar-like chart within the designated space for that particular game. This season chart being for baseball the sticker provides for the main 9 innings, extra innings, runs, hits, and errors in the conventional manner. It also lists the starting pitchers and any save pitchers with their name, record and era. Home runs can be listed by name, number hit and current season total. Several lines are left for notes of interest such as records set, ejection's, rain delays, etc. The stickers 30 are colored red for losses, blue for victories and yellow for cancellations.

Figure 6:
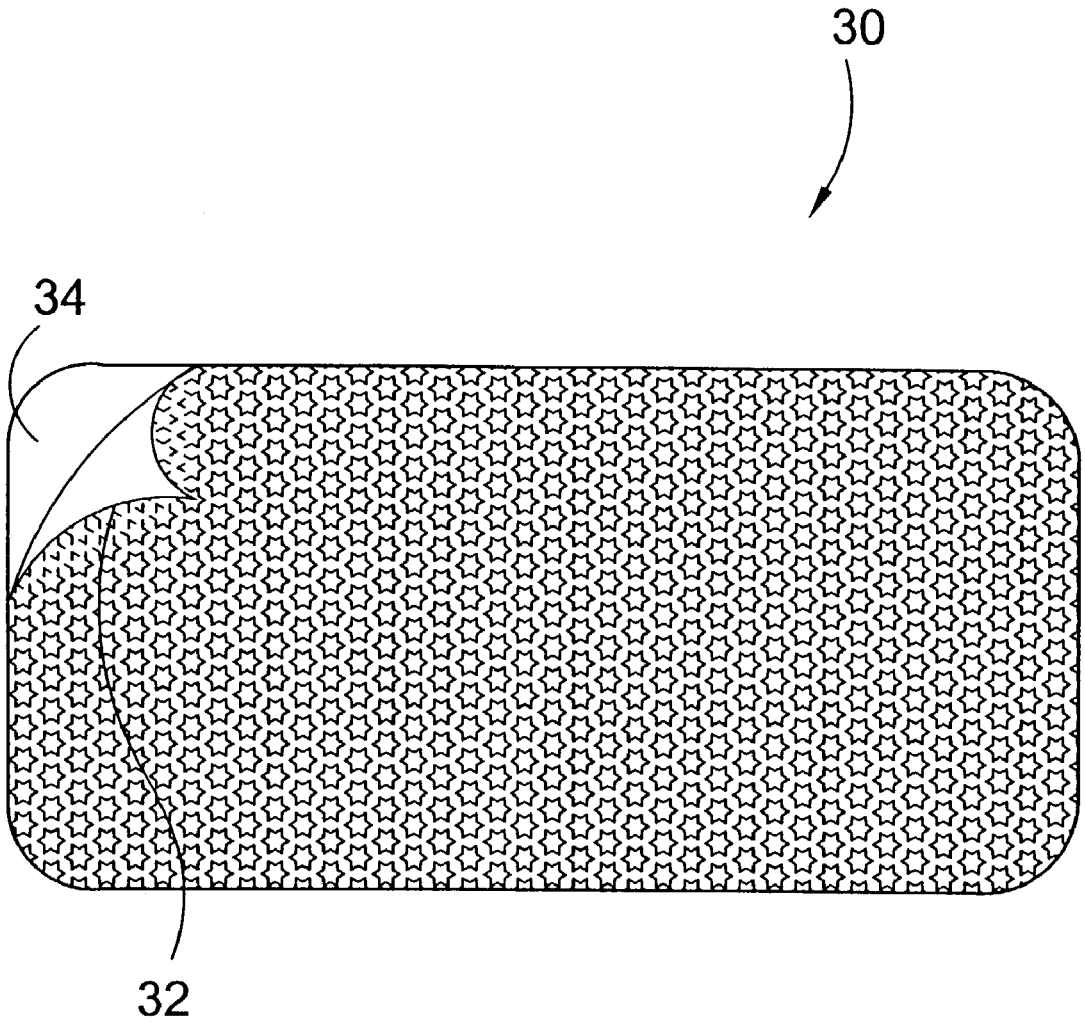
FIG. 6 is a rear view of the statistical game card.

Turning to FIG. 6, shown therein is a rear view of the statistical game card 30. Shown is a rear view of the statistical game card 30 having a peelably removable backing sheet 32. The backing sheet 32 is selectively removable to expose the protected glue surface 34 prior to attachment to the calendar-like chart 30. There can be other methods of attachment whereby the statistical game card 30 can be selectively removed from the calendar-like chart.

Figure 7:
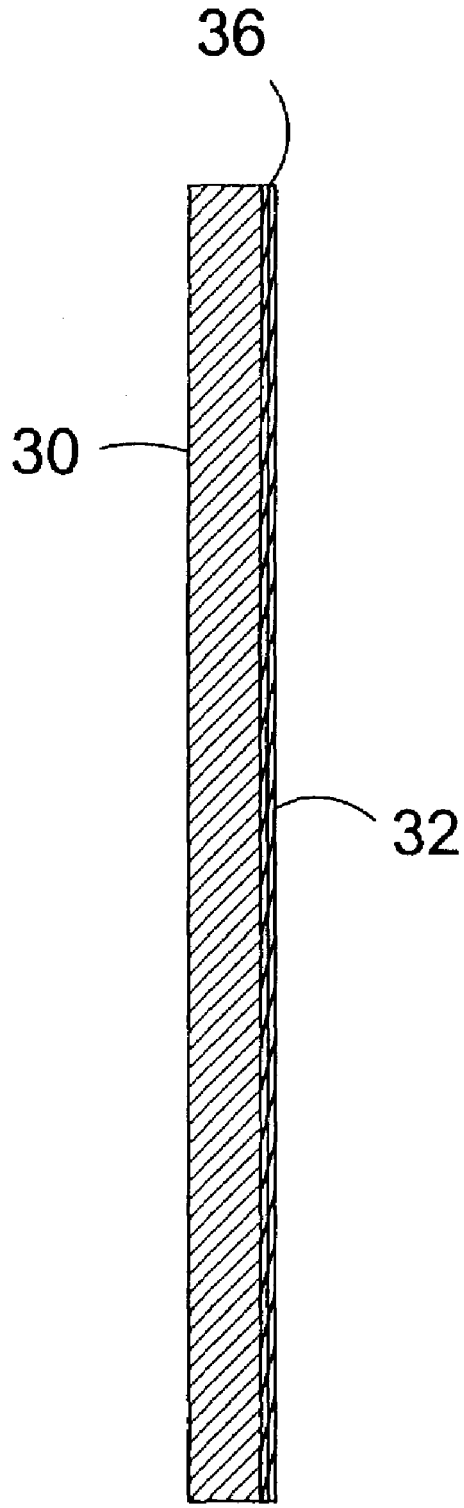
FIG. 7 is a side view of the statistical game card.

Turning to FIG. 7, shown therein is a side view of the statistical game card 30. Shown is a side view of the statistical game card 30 having a peelably removable backing sheet 32. The backing sheet 32 is selectively removable prior to attachment to the calendar-like chart. There can be other methods of attachment whereby the statistical game card 30 can be selectively removed from the calendar-like chart, for example, double-sided tape 36 as shown.

Figure 8:
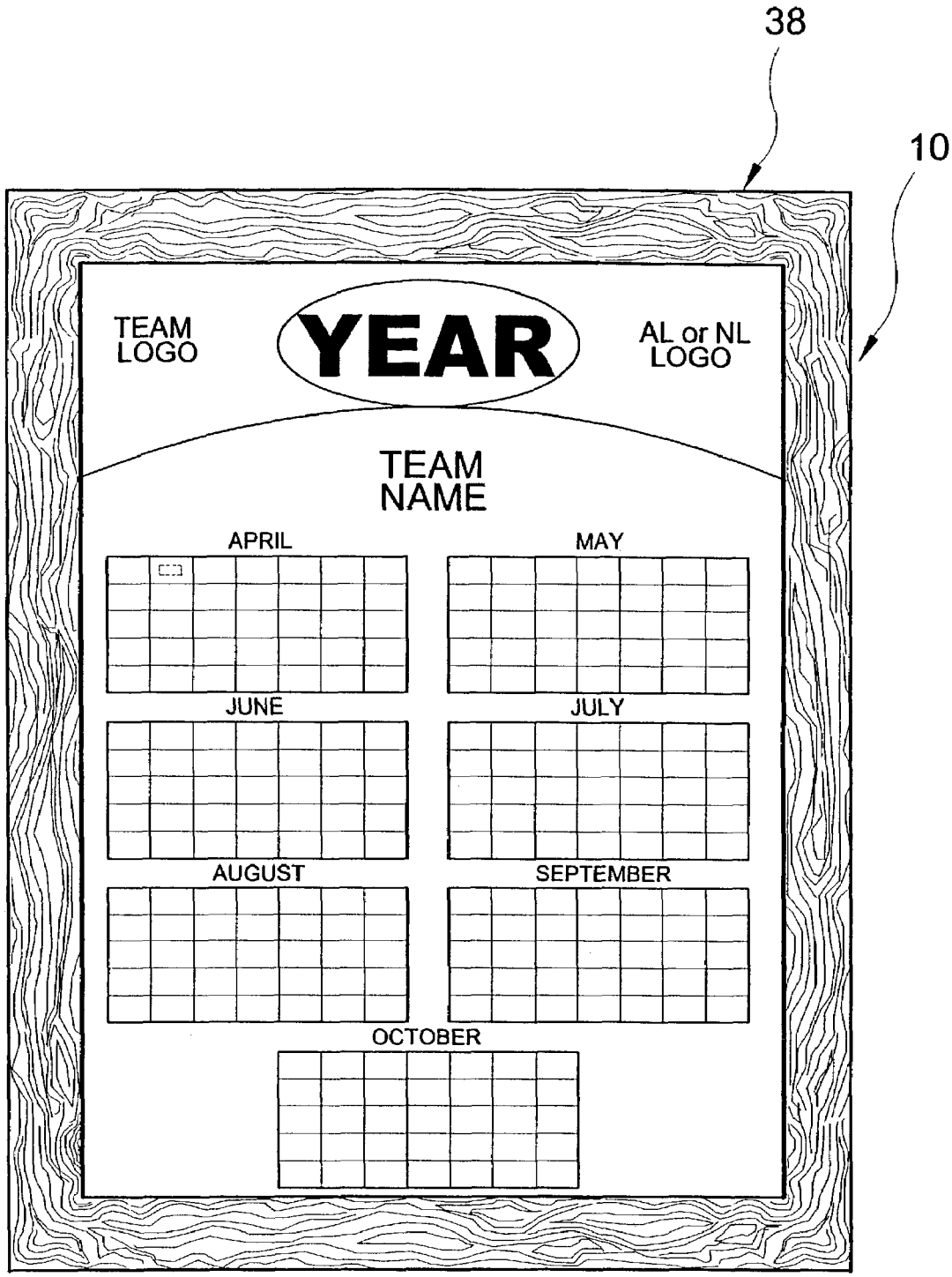
FIG. 8 is an illustrative view of the present invention having a frame.

Turning to FIG. 8, shown therein is an illustrative view of the present invention 10 having a frame 38. The present invention 10 is an interactive sports season team-tracking poster for a sports fan's favorite team having a frame 38 for the placement therein of the calendar-like chart. The baseball season chart is printed for the months of April through October with the favored team schedule imprinted thereon. The fan is able to record game statistics on an attachable preprinted statistics form and attach the statistics form onto the season chart for that game.

Turning to FIG. 9, shown therein is a conceptual view of a football statistical game card 30. Shown is an enlarged view of another statistical information game card 30 of the present invention that can be used to collect football game statistics. The game card 30 is attachable to the calendar-like sport season chart. The game card 30 is a preprinted form with labeled areas for recording game play statistics that can be selectively filled out by the fan. The game card 30 is attached to the calendar-like chart within the designated space for that particular game. The statistical game card 30 can also be configured for soccer, hockey and basketball.

What is claimed is:

1. An interactive seasonal sports team calendar, consisting of:

a) a sports team tracking poster that displays an entire season of play for said team, said poster being a single sheet defined by a top, a bottom, a pair of sides, a front side, and a back side, said front side of said poster having imprinted thereon information defining said team;

b) a calendar displayed on said front of said poster showing one space for each day of the sports season grouped by month on said single sheet with blank dates for rain dates and unscheduled games;

c) each of said spaces having a scheduled game imprinted with mnemonic information related to an opposing team and a designated area for a game card; and, d) said game card attached directly on said single sheet to each of said spaces in the designated areas, each said game card having a front side and a back side, said front side of said game card being imprinted to receive game related information and statistics for the particular scheduled game, permitting a user to enter information and statistics about the scheduled game played onto the game card, said back side of said game card having a glue surface protected by a peel-off backing to permit the game card to be attached to the space for the scheduled game on the front side of the poster so that at the end of the season of sports play there will be a visible complete statistical record for said team on said poster, each game card having a color code to represent a win, loss or cancellation of a game to permit the user to visually identify wins, losses or cancellations.

2. The apparatus of claim 1, wherein said information imprinted on said poster includes a team logo.

3. The apparatus of claim 2, wherein said information imprinted on said poster includes a league logo.

4. The apparatus of claim 3, wherein said back side of said game card further comprises two-sided tape backing to permit the game card to be attached to each space on the front of the poster.

5. The apparatus of claim 4, wherein said poster is mounted on a frame which extends across said top, bottom and pair of sides of said poster.

6. The apparatus of claim 5, wherein said imprint on said game card comprises a configuration suitable for displaying information and statistics for baseball.

7. The apparatus of claim 5, wherein said imprint on said game card comprises a configuration suitable for displaying information and statistics for football.

8. The apparatus of claim 5, wherein said imprint on said game card comprises a configuration suitable for displaying information and statistics for basketball.

9. The apparatus of claim 5, wherein said imprint on said game card comprises a configuration suitable for displaying information and statistics for soccer.

10. The apparatus of claim 5, wherein said imprint on said game card comprises a configuration suitable for displaying information and statistics for hockey.

* * * * *